United States Patent [19]

Haberrecker et al.

[11] Patent Number: 4,841,557

[45] Date of Patent: Jun. 20, 1989

[54] X-RADIATOR WITH CIRCULATING PUMP FOR HEAT DISSIPATION

[75] Inventors: Klaus Haberrecker, Bubenreuth; Rainer Roth, Dormitz, both of Fed. Rep. of Germany

[73] Assignee: Siemens Aktiengesellschaft, Berlin and Munich, Fed. Rep. of Germany

[21] Appl. No.: 915,704

[22] Filed: Oct. 6, 1986

[30] Foreign Application Priority Data

Nov. 7, 1985 [DE] Fed. Rep. of Germany ... 8531503[U]

[51] Int. Cl.[4] ..... H01J 35/10

[52] U.S. Cl. ..... 378/141; 378/127; 378/130; 378/200

[58] Field of Search ..... 378/141, 130, 200, 127

[56] References Cited

U.S. PATENT DOCUMENTS 2,259,037 10/1941 Graves ..... 378/200
4,369,517 1/1983 Ozawa .
4,734,927 3/1988 Leguen et al. ..... 378/200

FOREIGN PATENT DOCUMENTS 2170126 9/1973 France .
1527813 10/1978 United Kingdom .
2018019 10/1979 United Kingdom .
2034149 5/1980 United Kingdom .

OTHER PUBLICATIONS

"Medical X-Ray Technique Principles and Applications," Van Der Platts, Philips Technical Library, 1961, pp. 31–34.

*Primary Examiner*—Carolyn E. Fields
*Assistant Examiner*—David P. Porte
*Attorney, Agent, or Firm*—Hill, Van Santen, Steadman & Simpson

[57] ABSTRACT

An x-radiator has heat-producing components therein which are enclosed in a housing filled with an insulating fluid surrounding the components. A circulating pump is in fluid communication with the interior of the housing and has respective ports through which the fluid is circulated through the pump between the ports for aiding in dissipating heat from the components. The pump may be integrated within the housing, or attached to an exterior of the housing, with only its ports being in communication with the housing interior. The pump may be a squirrel-cage induction motor with a fluid conveying element, such as a ship's propellor forming a unit with the rotor and being arranged in a protective housing together with the stator.

17 Claims, 2 Drawing Sheets

X-RADIATOR WITH CIRCULATING PUMP FOR HEAT DISSIPATION

BACKGROUND OF THE INVENTION

The present invention relates to x-radiators, and in particular to an x-radiator having a means for dissipating heat from heat-producing components within the housing of the x-radiator.

X-radiators are known having a number of components therein which, during operation, produce considerable amounts of heat. For insulating purposes, such components are contained in a housing of the x-radiator which is filled with fluid, such as oil. An x-radiator of this type is described, for example, in "Medical X-Ray Technique Principles and Applications," Van der Platts, Philips Technical Library 1961, Pages 31–34.

In x-radiators of this type, high temperatures generally produced by the anode occur during operation. As is known, these high temperatures cause deceleration of the electrons approaching the anode. In order to eliminate this heat, the x-ray tube is constructed in a vessel, referred to as a tube bulb, which also prevents emission of x-rays in undesired directions. The volume remaining free of components within the tube head is filled with electrically insulating fluid, such as oil. The heat proceeding from the tube into the fluid is eliminated by simple thermal conduction (static cooling). This type of cooling can be further improved by providing cooling means, for example, conduits in which cooling water flows, in the housing (static forced cooling). The fluid filling the tube housing may also be circulated by pumping the fluid out of the housing and through a cooling block, and back into the housing (cooling induced by circulation). Particularly in tubes having a high load, static cooling has only a slight benefit, whereas forced cooling requires a complicated structure which presents difficulties if the x-radiator must be kept in motion during the exposure time, as in computer tomography.

SUMMARY OF THE INVENTION

It is an object of the present invention to provide an x-radiator of the type described above which includes an efficient and space-saving cooling means which can be united for co-movement with the x-radiator in a compact manner.

The above objects are achieved in accordance with the principles of the present invention in an x-radiator having a pump in fluid communication with the interior of the housing and means for mounting the pump integrated with the housing, i.e., contained in the housing or directly attached thereto, so as to be co-moveable with the x-radiator.

The invention disclosed herein proceeds from the recognition that it is beneficial for cooling the tube simply maintaining the insulating fluid, such as oil, in motion by a circulating pump. The pump is structurally united with the housing of the x-radiator so that movement of the x-radiator is not impeded, for example in computer tomography, by fluid or electrical lines leading between the pump and the housing. No additional leads are necessary in the structure disclosed herein. The pump makes use of the electrical wiring which is already present in the x-radiator for operating the components associated with radiation emission.

In one embodiment, the pump and drive motor are combined wherein the motor is a squirrel-cage induction motor. The rotor of the motor also functions as the conveying means for the pump, i.e., the pump is a part of the drive motor. This is achieved wherein the rotor of the motor is a pipe carrying the pump means, for example surrounding a propellor in the form of a ship's screw. Alternatively, the blades of the rotor of a centrifical pump may be placed at one end of the rotor. In a manner already known from x-ray tube technology, the rotor can be made of bi-laminar material of copper and iron. The favorable design is obtained by drawing a copper pipe over an iron pipe. The diameter of the rotor is thereby preferably matched to the required flow-through.

The rotor can be mounted by ball bearings on a shaft, the ball bearings being suspended by a plurality of supports to a pipe of special steel surrounding the rotor. The stator can be attached to the outside of this pipe. The stator can be of the type which is used for driving the anode in rotating anode x-ray tubes. As in such x-ray tubes, the rotor can be accomodated in the tube head or housing so that it is surrounded by the insulating coolant. Alternatively, the pump can be attached to the head so that the rotor is disposed outside of the housing.

Line AC current of 50 or 60 Hz can be employed for driving the pump, which is the same current utilized for operating the motor for driving the anode of the x-ray tube. For such a rotating anode x-ray tube, no additional power supply need be provided for the pump, because a drive current for the rotating anode is already provided.

DESCRIPTION OF THE PREFERRED EMBODIMENTS

Figure 1:
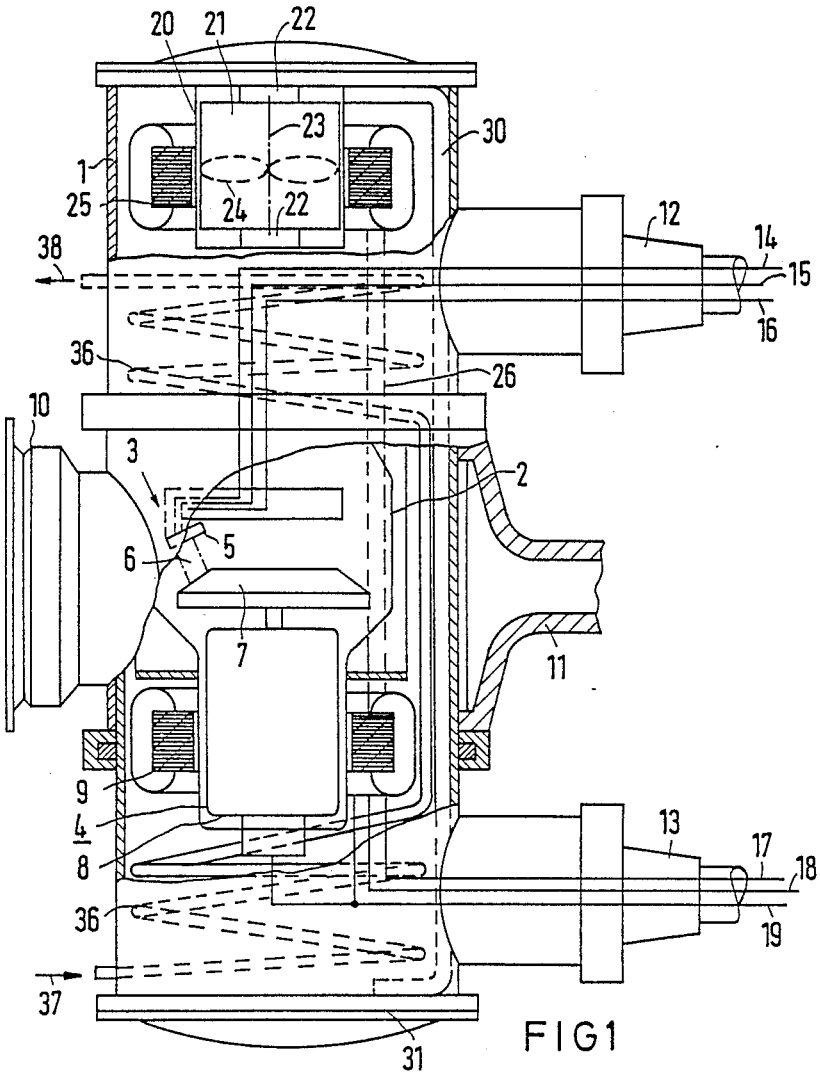
FIG. 1 is a side view, partly broken away, of an x-radiator constructed in accordance with the principles of the present invention.

An x-radiator constructed in accordance with the principles of the present invention is shown in FIG. 1 having a housing or tube head 1 which includes a rotating anode x-ray tube 2. The tube 2 contains a cathode arrangement 3 and an anode arrangement 4 disposed opposite thereto. The cathode arrangement 3 includes a thermionic cathode having two separately switchable filaments. An anode dish 7 is disposed spaced from and opposite the thermionic cathode 5. The thermionic cathode 5 emits electrons which are incident on a focal spot path of the anode dish 7. The anode dish 7 is connected via a shaft to a rotor 8 employed in a known manner for rotating the dish 7.

A stator 9 is mounted outside of the tube 2 at a location surrounding the rotor 8. The tube head 1 has a beam exit tube 10 at a side thereof facing the x-ray exit of the tube 2. The tube head 1 is mounted by a bracket 11 in a known manner so as to be positionally adjustable in an x-ray apparatus.

Operating voltages for the x-radiator are supplied via terminal 12 on lines 14, 15 and 16 and via terminal 13 on lines 17, 18 and 19 in a known manner. These lines are connected to a supply unit, such as a high-voltage generator, fed from the main.

In the embodiment of FIG. 1, a housing 20 for a circulating pump is disposed in the interior of the tube head 1 at an upper end thereof. The housing 20 contains a rotor 21 mounted on a shaft 23 which is in turn seated in bearings 22. The tube head 1 is filled with an insulating coolant, such as oil, and the rotor 21 is in fluid communication with the interior of the tube head 1. A propellor 24 for conveying the fluid coolant through the pump is also disposed inside the rotor 21. The rotor 21 is placed in motion by a stator 25 disposed outside of the housing 20. The stator is supplied with drive current by lines 26 and 27, which is the same drive current supplied to the stator 9 for the tube 2 via lines 17 and 18. The propellor 24 rotates and oil is forced from the interior of the tube head 1 into a conduit 30, which discharges at an opposite end 31 of the tube head 1, i.e., the end of the tube head 1 away from the pump. Circulation of the coolant filling the tube head 1 thus is achieved during operation of the pump. In this embodiment, therefore, the intake port of the pump is disposed proximate the pump itself, while the discharge or outlet port is disposed away from the pump with the heat-generating components of the x-ray tube therebetween.

Figure 2:
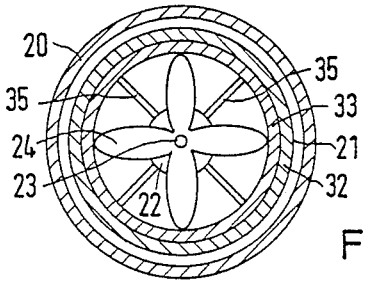
FIG. 2 is a plan view of the pump constructed in accordance with the principles of the present invention in the x-radiator shown in FIG. 1.

As shown in FIG. 2, the rotor 21 may be constructed of an exterior pipe 32 and an interior pipe 33. The interior pipe 32 may consist, for example, of copper and have a thickness in the range of about 1 mm through about 3 mm, preferably 1.5 mm and an inside diameter of 52 mm. The pipe 33 may consist, for example, of iron and has a thickness in the range of, for example, about 1 mm through about 3 mm, preferably 1 mm. Supports 35 are provided for holding the bearing 23 in the housing 20.

To further promote cooling of the insulator filling the tube head 1, cooling water can be conducted through a conduit 36 as indicated by arrows 37 and 38.

Figure 3:
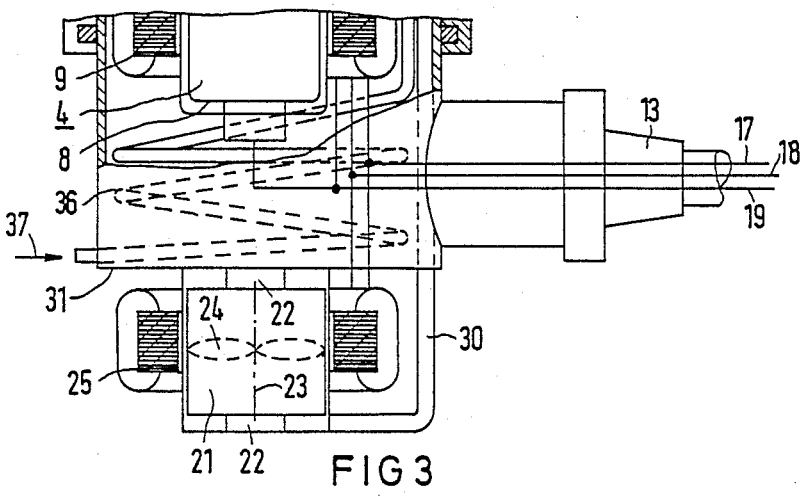
FIG. 3 is a side view, partly in section and partly broken away, of a portion of the x-radiator of FIG. 1 showing an alternative location of the pump.

In the embodiment of FIG. 3, the pump is disposed at the opposite end 31 of the tube head, but is otherwise constructed as described in the embodiment of FIG. 1. In this embodiment, however, operation of the pump is such that coolant is suctioned from the interior of the tube head 1 at the end of the conduit 30 and is drawn through the pump and returned to the interior of the tube head 1. In this embodiment, therefore, the discharge port of the pump is proximate the pump itself, and the intake port is disposed away therefrom, with the heat-producing components therebetween.

Figure 4:
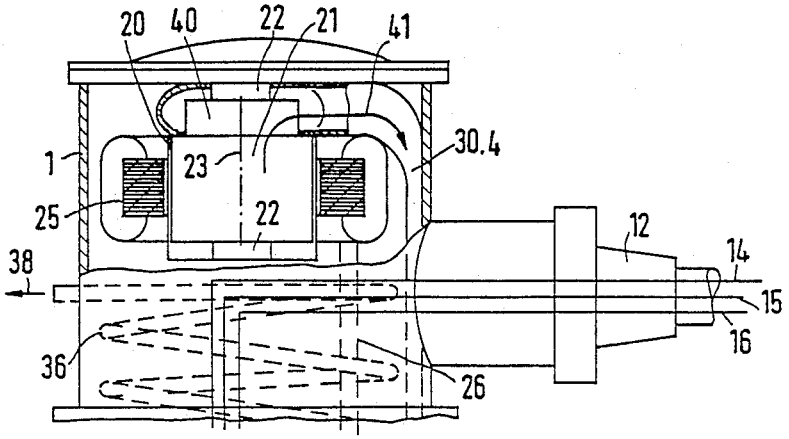
FIG. 4 is a side view, partly in section and partly broken away, of another embodiment of an x-radiator constructed in accordance with the principles of the present invention employing a different type of pump from that shown in FIG. 1.

In the embodiment of FIG. 4, the pump is in the form of a centrifugal pump wherein the stator 24 is as described above and is attached at the outside of the pump housing 20. In this embodiment, the blades 40 for the centrifugal pump are attached at a top of the rotor 21, which rotates about the shaft 23 mounted in bearings 22. The insulating coolant, as indicated by the arrow 41, is forced into the discharge conduit, which in this embodiment has a funnel-like top portion in which the blades 40 are disposed. Circulation of the coolant is as described in connection with FIG. 1.

Although modifications and changes may be suggested by those skilled in the art it is the intention of the inventors to embody within the patent warranted hereon all changes and modifications as reasonably and properly come within the scope of their contribution to the art.

We claim as our invention:

1. An x-radiator having a housing containing heat-emitting components, an insulating fluid filling the interior of said housing surrounding said components, and a pump means mounted integrated with said housing in fluid communication with the interior of said housing for circulating said fluid for at least partially dissipating the heat from said components, said pump means including a fluid mover, a first port disposed at one end of said housing proximate said fluid mover, and a second port disposed at an opposite end of said housing, said fluid mover being connected to said second port by a conduit integrated with said housing to move said fluid over said components in one direction between said ports.

2. An x-radiator as claimed in claim 1, wherein said fluid mover is disposed in the interior of said housing.

3. An x-radiator as claimed in claim 1, wherein said fluid mover is attached at an exterior of said housing.

4. An x-radiator as claimed in claim 1, wherein said heat-emitting components are disposed between said first and second ports.

5. An x-radiator as claimed in claim 1, wherein said first port is an intake port and said second port is a discharge port.

6. An x-radiator as claimed in claim 1, wherein said first port is a discharge port and said second port is an intake port.

7. An x-radiator as claimed in claim 1, further comprising a conduit disposed in the interior of said housing for circulating a coolant through said conduit for further assisting in dissipating the heat from said components.

8. An x-radiator as claimed in claim 1, wherein said fluid mover is a centrifugal pump having a rotor with blades for conveying fluid attached at one end of said rotor.

9. An x-radiator having a housing containing heat-emitting components, an insulating fluid filling the interior of said housing and surrounding said components, and a pump means mounted integrated with said housing in fluid communication with interior of said housing for circulating said fluid for at least partially dissipating the heat from said components, said pump means including an electric squirrel-cage induction motor having a hollow rotor with a propeller therein for conveying said fluid through said pump means, a first port disposed at one end of said housing proximate said hollow rotor, and a second port disposed at an opposite end of said housing, said hollow rotor being connected to said second port by a conduit integrated with said housing to move said fluid over said components in one direction between said ports.

10. An x-radiator as claimed in claim 9, wherein said rotor consists of inner and outer adjacent concentric cylinders.

11. An x-radiator as claimed in claim 10, wherein said inner cylinder consists of iron and has a thickness in the range of about 1 mm through about 3 mm, and wherein said outer cylinder consists of copper and has a thickness in the range of about 1 mm through 3 mm.

12. An x-radiator as claimed in claim 11, wherein said inner cylinder has a thickness of 1 mm and said outer cylinder has a thickness of 1.5 mm.

13. An x-radiator as claimed in claim 10, wherein said inner cylinder is an iron pipe and said outer cylinder is a copper pipe pulled over said iron pipe.

14. An x-radiator comprising:

a housing having an interior with opposite ends;

a plurality of heat-emitting components disposed in said interior of said housing;

an insulating fluid filling said interior of said housing surrounding said components; and a pump integrated with said housing having a first port in fluid communication with said interior of said housing disposed at one end of said housing and having a second port disposed at an opposite end of said housing for circulating said fluid through said pump between said ports in one direction.

15. An x-radiator as claimed in claim 14, wherein said first port is an intake port and wherein said second port is a discharge port.

16. An x-radiator as claimed in claim 14, wherein said first port is a discharge port and wherein said second port is an intake port.

17. An x-radiator as claimed in claim 14, wherein said heat-emitting components are disposed in said housing between said first and second ports of said pump.

* * * * *